US006595720B2

(12) United States Patent
Humphries et al.

(10) Patent No.: US 6,595,720 B2
(45) Date of Patent: Jul. 22, 2003

(54) METHOD AND APPARATUS FOR FORMING A TRENCH DRAIN

(75) Inventors: Derek Humphries, Chardon, OH (US); James A. McConnell, Rome, OH (US)

(73) Assignee: ACO Polymer Products, Inc., Chardon, OH (US)

( * ) Notice: Subject to any disclaimer, the term of this patent is extended or adjusted under 35 U.S.C. 154(b) by 0 days.

(21) Appl. No.: 10/004,056

(22) Filed: Nov. 1, 2001

(65) Prior Publication Data

US 2003/0082009 A1 May 1, 2003

(51) Int. Cl.[7] ..... E02B 5/00

(52) U.S. Cl. ..... 405/118; 405/119; 249/10; 404/2; 52/323

(58) Field of Search ..... 405/36, 43, 46, 405/50, 118, 119, 282, 283; 249/1, 4, 10–12; 404/2–4; 52/323, 576

(56) References Cited

U.S. PATENT DOCUMENTS 4,878,782 A * 11/1989 Beattie et al. ..... 405/119
4,993,878 A 2/1991 Beamer
5,066,165 A * 11/1991 Wofford et al. ..... 405/119
5,256,000 A * 10/1993 Beamer ..... 405/119
5,489,163 A * 2/1996 Thomann ..... 405/118
5,538,361 A * 7/1996 Beamer ..... 405/118
5,799,455 A * 9/1998 Gates et al. ..... 52/323
5,879,106 A * 3/1999 Beamer ..... 405/36
6,004,068 A 12/1999 Hosley
6,220,784 B1 4/2001 Bricker

FOREIGN PATENT DOCUMENTS

JP 57146810 * 9/1982 ..... 405/282

* cited by examiner

*Primary Examiner*—Jong-Suk (James) Lee
(74) *Attorney, Agent, or Firm*—Pearne & Gordon LLP

(57) ABSTRACT

A method and apparatus for forming a trench drain includes an elongated trench form, first and second spaced apart frame rails, a support member and a first and second fastener. The trench form includes at least one folding member folded along predetermined lines. The support member is affixed to the first and second frame rails to maintain the first and second rails in a fixed position relative to each other. The support member includes first and second fastener bearing surfaces spaced above respective uppermost surfaces of transverse portions of the first and second frame rails. The first and second fastener bear against fastener bearing surfaces of the support member and releasably engage the first and second frame rail. A joint support member may be included to align adjacent trench drain assemblies.

25 Claims, 6 Drawing Sheets

METHOD AND APPARATUS FOR FORMING A TRENCH DRAIN

FIELD OF THE INVENTION

The present invention is directed to method and apparatus for forming a trench drain and, more specifically, to method and apparatus for forming a trench drain including a removable form, two side rails and a plurality of cross members spanning the side rails for improved stability and alignment and ease of installation.

BACKGROUND ART

Trench drains have been used in construction for centuries. In modern times, trench drains have been used to collect runoff water and channel it to other locations preventing flooding. Trench drains also provide chemical spill control by preventing chemical spills from escaping into the environment.

Parking lots, airport runways, loading docks, shop floors and other large cement or asphalt areas typically include spaced apart trench drains cover by metal grates. A typical trench drain may be 24 inches deep by 12 inches wide, and may be hundreds or even thousands of feet in length. Opposing ends of a trench drain are disposed at different altitudes to facilitate liquid flow. A conventional trench drain may drop 1 inch in altitude for every 8 feet in length.

A trench drain is typically covered by a metal grate having openings which permit the flow of water into the trench drain while the grate is sufficient to support the weight of vehicles moving across the grate. The grate is supported by the upper edges of the trench drain such that the upper surface of the grate is substantially level with the upper surface of the surrounding cement or asphalt to facilitate persons and vehicles passing over the grate. Typically, the grate is mounted onto frame rails that are installed during or after the formation of the trench. The mounting holes may serve a function during trench fabrication as well.

Several conventional trench drain designs have been used. A trench drain may be formed in place using plywood to make both a bottom form and side forms, which must be removed after concrete is applied and set adjacent the forms. This construction method is time consuming and requires a carpenter to build the forms. Alternatively, some trench drains are made of precast concrete, which are extremely bulky and require heavy equipment to lower them into place. Because of their weights, they can be dangerous during placement and can cause serious injury or death. They must be transported by tractor trailers or similar method to the job sites because of their bulk. The precast forms require significant shipping costs.

Styrofoam forms are a relatively recent alternative product to enter the market. They are comprised of solid foam that is cut into the shape of a trench drain, use elongated steel members and supports to hold them prior to concrete encasement. They are comprised of solid foam forms that are cut to the shape of the basin desired, and use steel frame rails and supports to suspend them prior to concrete encasement. Foam forms are expensive to ship due to relatively large bulk in comparison to little weight. They are susceptible to damage in transit and expensive compared to wood forming techniques. In addition, styrofoam is flammable and can give off toxic gases. It is susceptible to breaking into small pieces during use and is easily scattered in outdoor applications. The material is increasingly regulated by government agencies. Also, some landfills do not accept styrofoam because it will not naturally decompose. In light of the above discussion, styrofoam is an undesirable material for use in forming trench drains.

Recently, various types of apparatus for forming trench drains have been proposed. One proposed solution includes the use of a removable form composed of polystyrene. This solution suffers from the discussed inherent weaknesses of styrofoam. Further, cross-supports used to assist in alignment are disposed below the level of the concrete. Hardware used to secure the cross-supports would likely be encased in concrete. Any attempt to commercially practice this solution would require timely and difficult measures to remove hardware. The hardware must be removed prior to removing the polystyrene form and installing a metal grate.

U.S. Pat. No. 6,004,068 to Hosley, and issued Dec. 21, 1999, disclosed a second proposed solution. A corrugated form is assembled from several folding members and inserted into an excavated void. A plurality of U-shaped brackets are used to secure frame rails on either side of the form. However, the assembly is susceptible to deformation of the form or misalignment between opposing frames. Although the frames may stay in a parallel relationship to each other, they may "parallelogram" with respect to a longitudinal axis of the trench. In this condition, any support used to connect the rails would not be at a 90° angle with each rail. Adjacent assembly sections may also be misaligned at joining points.

Alignment problems may be caused by human error during assembly. More frequently, misalignment is caused by the buoyancy forces imposed by the hardening material. Deformation of the form can result in an uneven bottom trench surface, adversely affecting liquid flow. Misalignment of frames can result in frames encased with portions above the surface of the concrete. This condition requires expensive rework when detected. If not detected, and the metal grates are installed, damaged to equipment or serious injury to personnel can result.

Certain applications, such as airports, require the installed metal grate to be secured with locking hardware. Misalignment between the rails causing the mounting hole location to move at small as ⅛" can prevent proper locking of the grates.

Ideally, a trench drain forming apparatus should be inexpensive to fabricate and potentially reusable. It should fold flat for easy and inexpensive transportation. Further, a trench drain forming apparatus should be easy to assemble ditch by relatively unskilled labor and install in the trench or void. The trench drain forming apparatus should be strong and stable to stay in place while the concrete is being poured and cured. Opposing frame rails should be held in proper alignment. The assembly should facilitate alignment between adjacent sections of the form so that the trench drain is continuous, without steps or ridges between form sections. The metal grate should be easily and safely lockable to the frame rails. Finally, the forming apparatus should facilitate easy removal after the concrete has dried or cured.

There is a need in the market for a method and apparatus for forming a trench drain offering the above discussed advantages.

SUMMARY OF THE INVENTION

The present invention is directed to method and apparatus for forming a trench drain offering improved stability and alignment.

In one embodiment, the apparatus for forming a trench drain includes an elongated trench form, first and second spaced apart frame rails, a support member removably affixed to the first and second frame rails and a first and second fastener.

The elongated trench form inserts into a trench along a longitudinal axis of the trench. The form is comprised of at least one folding member folded along predetermined lines to define a top surface, a bottom surface, and first and second spaced apart side surfaces.

The first and second spaced apart frame rails support the trench form. Each rail includes a horizontal portion, a transverse portion extending upwardly from the horizontal portion and a trench form engaging surface. The first frame rail abuts the first side surface of the form and the second frame rail abuts the second side surface of the form.

The support member is removably affixed to the first and second frame rails to maintain the first and second rails in a fixed position relative to each other. The support member includes a first opening extending through the support member adjacent one end of the support member and a first fastener bearing surface surrounding the first opening. The support member further includes a second opening extending through the support member adjacent an opposite end of the support member and a second fastener bearing surface surrounding the second opening. The first and second fastener bearing surfaces of the support member are spaced above respective uppermost surfaces of the transverse portions of the first and second frame rails.

The first fastener bears against the first fastener bearing surface of the support member, extends through the first opening of the support member and releasably engages the first frame rail. The second fastener bears against the second fastener bearing surface of the support member, extends through the second opening of the support member and releasably engages the second frame rail.

The trench form may include an outer form, a base form, a box form and a top form. The outer form has parallel first and second side walls defining the first and second side surfaces and a bottom wall defining the bottom surface. The base form is disposed in an interior region defined by the outer form. The box form is disposed in an interior region defined by the outer form and includes a plurality of cross members extending between the first and second side walls. The top form has a top wall defining the top surface.

The trench form may be made of corrugated cardboard. The predetermined lines may be weakened by scoring or perforation to facilitate folding. The trench form may include a wooden insert disposed between an upper surface of the box form and a lower surface of the top form.

The opposing edges of the top form may be folded in the shape of a square and disposed on respective trench form engaging surfaces of the first and second frame rails.

The first and second fasteners may include threaded studs which are threaded into respective threaded openings in the first and second frame rails and wing nuts which thread onto respective threaded studs and bear against respective first and second fastener bearing surfaces of the support member.

The top form may include slots through which upwardly extending tab portions of the first and second side walls protrude to releasably secure the top form to the outer form.

The support member may includes first and second vertically oriented cylindrical extensions sized to fit into corresponding first and second openings in the top form wherein the first and second openings of the support member extend through the cylindrical extensions.

The bottom wall of the outer form may be V-shaped resulting in a V-shaped bottom for the trench drain after hardening material has been poured in the trench and the trench form has been removed.

The first and second frame rails may include at least one extending leg having means for receiving an anchoring rod capable of being secured to ground defining the trench.

In an alternative embodiment, the apparatus for forming a trench drain includes first and second elongated trench forms, a first and second set of frame rails, a first and second cross member, a joint support member and a first and second fastener.

The first and second elongated trench forms insert into a trench. Each of the first and second forms include at least one folding member folded along predetermined lines to define a top surface, a bottom surface, and first and second spaced apart side surfaces. The first and second forms are positioned in longitudinal alignment to extend along a longitudinal axis of the trench.

The first set of frame rails includes first and second spaced apart frame rails to support the first trench form. Each rail includes a horizontal portion, a transverse portion extending upwardly from the horizontal portion and a trench form engaging surface. The first frame rail abuts the first side surface of the form and the second frame rail abuts the second side surface of the form;

The second set of frame rails includes third and fourth spaced apart frame rails to support the second trench form. Each rail comprising a horizontal portion, a transverse portion extending upwardly from the horizontal portion and a trench form engaging surface. The third frame rail abuts the first side surface of the form and the fourth frame rail abuts the second side surface of the form. The first and third frame rails are in alignment and the second and fourth frame rails are in alignment.

The first cross member is removably affixed to the first and second frame rails of the first set of frame rails to maintain the first and second rails in a fixed position relative to each other.

The second cross member is removably affixed to the third and fourth frame rails of the second set of frame rails to maintain the third and fourth rails in a fixed position relative to each other.

The joint support member is removably affixed to the first and fourth frame rails to maintain the first and fourth frame rails in a fixed position relative to each other. The support member includes a first opening extending through the support member adjacent one end of the support member and a first fastener bearing surface surrounding the first opening. The support member further includes a second opening extending through the support member adjacent an opposite end of the joint member and a second fastener bearing surface surrounding the second opening. The first and second fastener bearing surfaces of the joint member are spaced above respective uppermost surfaces of the transverse portions of the first and fourth frame rails.

The first fastener bears against the first fastener bearing surface of the joint support member, extends through the first opening of the joint support member, and releasably engages the first frame rail. The second fastener bears against the second fastener bearing surface of the joint support member, extends through the second opening of the joint support member, and releasably engages the fourth frame rail.

In a second alternative embodiment, the apparatus for forming a trench drain includes first and second elongated trench forms, a first and second set of frame rails, a first and second cross support member, a joint support member and a first, second, third, fourth, fifth and sixth fastener.

The first and second elongated trench forms insert into a trench. Each of the first and second forms include at least one folding member folded along predetermined lines to define a top surface, a bottom surface, and first and second spaced apart side surfaces. The first and second forms are positioned in longitudinal alignment to extend along a longitudinal axis of the trench.

The first set of frame rails includes first and second spaced apart frame rails to support the first trench form. Each rail includes a horizontal portion, a transverse portion extending upwardly from the horizontal portion and a trench form engaging surface. The first frame rail abuts the first side surface of the form and the second frame rail abuts the second side surface of the form.

The second set of frame rails includes third and fourth spaced apart frame rails to support the second trench form. Each rail includes a horizontal portion, a transverse portion extending upwardly from the horizontal portion and a trench form engaging surface. The third frame rail abuts the first side surface of the form and the fourth frame rail abuts the second side surface of the form. The first and third frame rails are in longitudinal alignment and the second and fourth frame rails are in longitudinal alignment.

The first cross support member is removably affixed to the first and second frame rails of the first set of frame rails to maintain the first and second rails in a fixed position relative to each other. The first support member includes a first opening extending through the support member adjacent one end of the support member and a first fastener bearing surface surrounding the first opening. The first support member further includes a second opening extending through the support member adjacent an opposite end of the support member and a second fastener bearing surface surrounding the second opening. The first and second fastener bearing surfaces of the support member are spaced above respective uppermost surfaces of the transverse portions of the first and second frame rails.

The first fastener bears against the first fastener bearing surface of the first cross support member, extends through the first opening of the support member, and releasably engages the first frame rail. The second fastener bears against the second fastener bearing surface of the first support member, extends through the second opening of the support member, and releasably engages the second frame rail.

The second cross support member is removably affixed to the third and fourth frame rails of the second set of frame rails to maintain the third and fourth rails in a fixed position relative to each other. The second support member includes a first opening extending through the support member adjacent one end of the support member and a first fastener bearing surface surrounding the first opening. The second support member further includes a second opening extending through the support member adjacent an opposite end of the support member and a second fastener bearing surface surrounding the second opening. The first and second fastener bearing surfaces of the support member are spaced above respective uppermost surfaces of the transverse portions of the third and fourth frame rails.

The third fastener bears against the first fastener bearing surface of the second cross support member, extends through the first opening of the support member, and releasably engages the third frame rail. The fourth fastener bears against the second fastener bearing surface of the second support member, extends through the second opening of the support member, and releasably engages the fourth frame rail.

The joint support member is removably affixed to the first and fourth frame rails to maintain the first and fourth frame rails in a fixed position relative to each other. The support member includes a first opening extending through the support member adjacent one end of the support member and a first fastener bearing surface surrounding the first opening. The support member further includes a second opening extending through the support member adjacent an opposite end of the support member and a second fastener bearing surface surrounding the second opening. The first and second fastener bearing surfaces of the support member are spaced above respective uppermost surfaces of the transverse portions of the first and fourth frame rails.

The fifth fastener bears against the first fastener bearing surface of the joint support member, extends through the first opening of the joint support member, and releasably engages the first frame rail. The sixth fastener bears against the second fastener bearing surface of the joint support member, extends through the second opening of the joint support member, and releasably engages the fourth frame rail.

A method of forming a trench drain includes the first step of forming a trench in the ground extending along a longitudinal axis. A second step includes assembling a trench form comprised of at least one folding member folded along predetermined lines.

A next step includes positioning a first set of frame rails so as to extend along the longitudinal axis of the trench and to engage and support the trench form. A next step includes positioning the trench form so as to engage and be supported by the first and second frame rails.

A next step includes providing a support member to releasably secure the first frame rail to the second frame rail to maintain the first and second rails in a fixed position relative to each other. The support member includes a first opening extending through the support member adjacent one end of the support member and a first fastener bearing surface surrounding the first opening. The support member further includes a second opening extending through the support member adjacent an opposite end of the support member and a second fastener bearing surface surrounding the second opening. The first and second fastener bearing surfaces of the support member are spaced above respective uppermost surfaces of the first and second frame rails.

A next method step includes securing the support member to the first and second frame rails by two intermediate steps. The first intermediate step includes fastening a first fastener between the support member and the first frame rail. The first fastener bears against the first fastener bearing surface of the support member, extends through the first opening of the support member, and releasably engages the first frame rail. The second intermediate step includes fastening a second fastener between the support member and the second frame rail. The second fastener bears against the second fastener bearing surface of the support member, extends through the second opening of the support member, and releasably engages the second frame rail.

A next step includes applying hardening compound into the trench in areas adjacent the first and second trench forms. A final step includes removing the first and second fasteners, the support member and the trench form.

An alternative method of forming a trench drain is also disclosed. The alternative method includes a first step of forming a trench in the ground extending along a longitudinal axis. A second step includes assembling first and second trench forms.

A step includes positioning a first and second frame rail in spaced apart relationship so as to extend along the longitudinal axis of the trench and to engage and support the first trench form.

A step includes positioning the first trench form so as to engage and be supported by the first and second frame rails.

A step includes positioning a third and fourth frame rail in spaced apart relationship so as to extend along the longitudinal axis of the trench and to engage and support the second trench form.

A step includes positioning the second trench form so as to engage and be supported by the third and fourth frame rails.

The next step includes providing a joint support member to releasably secure the first frame rail to the fourth frame rail. The joint support member is adapted to removably engage the first and fourth frame rails to maintain the first and fourth rails in a fixed position relative to each other. The joint support member includes a first opening extending through the cross support member adjacent one end of the support member and a first fastener bearing surface surrounding the first opening. The joint member further includes a second opening extending through the joint support member adjacent an opposite end of the support member and a second fastener bearing surface surrounding the second opening. The first and second fastener bearing surfaces of the cross support member are spaced above respective uppermost surfaces of transverse portions of the first and fourth frame rails.

A next method step includes securing the joint support member to the first and fourth frame rails by two intermediate steps. The first intermediate step includes fastening a first fastener between the joint support member and the first frame rail. The first fastener bears against the first fastener bearing surface of the cross support member, extends through the first opening of the cross support member, and releasably engages the first frame rail. The second intermediate step includes fastening a second fastener between the joint support member and the fourth frame rail. The second fastener bears against the second fastener bearing surface of the cross support member, extends through the second opening of the cross support member, and releasably engages the fourth frame rail.

A next step includes applying hardening compound into the trench in areas adjacent the first and second trench forms. A final step includes removing the first and second fasteners, the joint support member and the first and second trench forms.

These and other objects, advantages and features of the invention will become better understood from a detailed description of an exemplary embodiment of the invention which is described in conjunction with the accompanying drawings.

DETAILED DESCRIPTION OF THE PREFERRED EMBODIMENT

Figure 1:
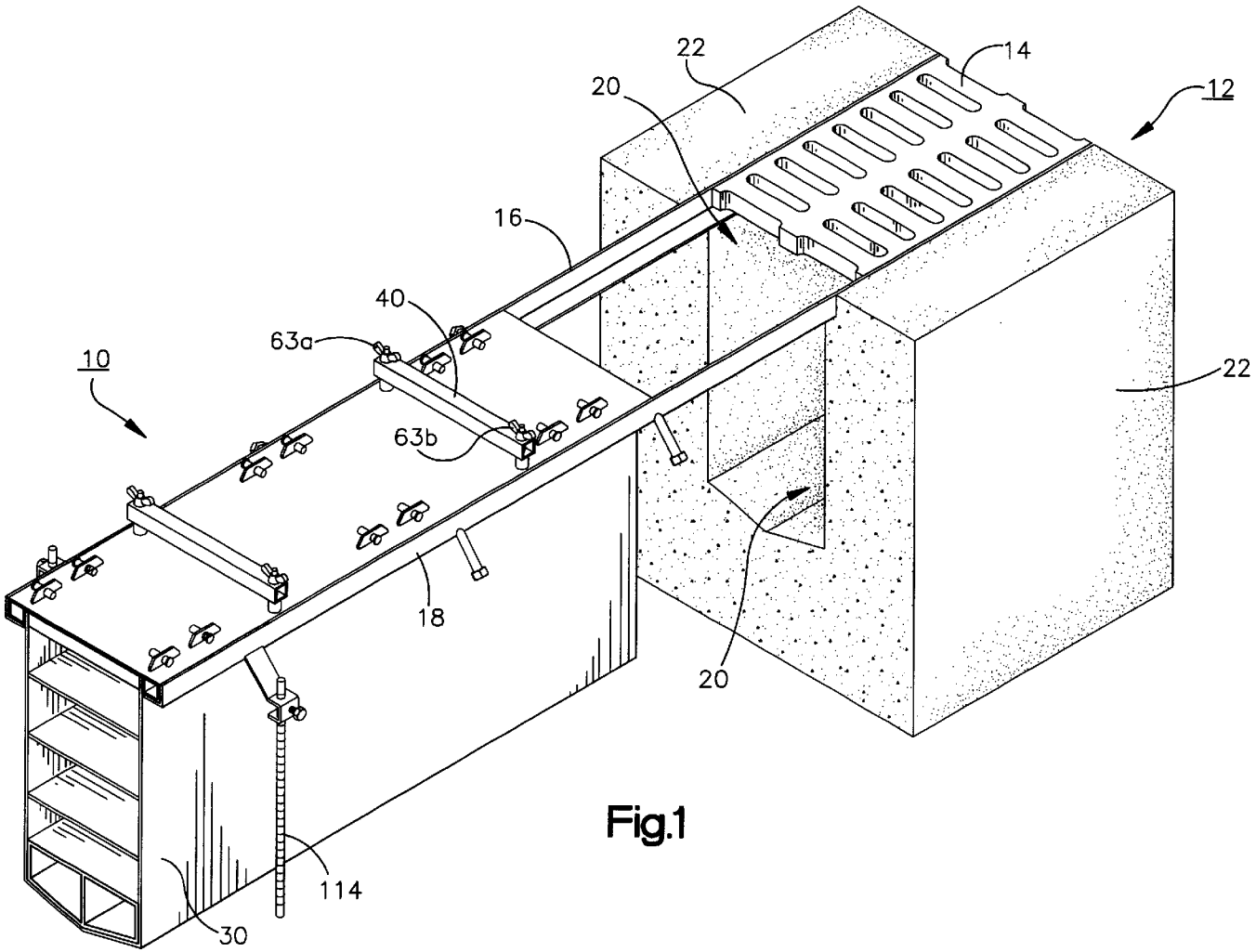
FIG. 1 is a perspective view of one embodiment of a trench drain forming apparatus of the present invention, showing a portion of the apparatus and a portion of a finished trench drain.

Referring now to the drawings, a perspective view of one embodiment of a trench drain forming apparatus 10 is illustrated in FIG. 1. A portion of the apparatus 10 and a portion of a finished trench drain 12 are shown. The finished trench drain 12 includes a metal grate 14 mounted onto a first frame rail 16 and a second frame rail 18. The metal grate include imperforations which permit liquid to flow into a trench. The trench is defined by cavity walls 20 formed by a hardening material 22. The hardening material is poured into a void created in the ground by known excavation methods.

The apparatus 10 includes an elongated trench form 30 for insertion into a trench. The form is inserted along a longitudinal axis of the trench. As illustrated in FIG. 1, one embodiment of the present invention utilizes one trench form 30 for every eight feet of length of the trench. As illustrated, the trench form 30 includes a plurality of folding members folded by along predetermined lines to define a top surface 30*a*, a bottom surface 30*b*, and first 30*c* and second 30*d* spaced apart side surfaces. The folding members are best illustrated in FIGS. 3A–3E, showing a series of progressive views.

Figure 2:
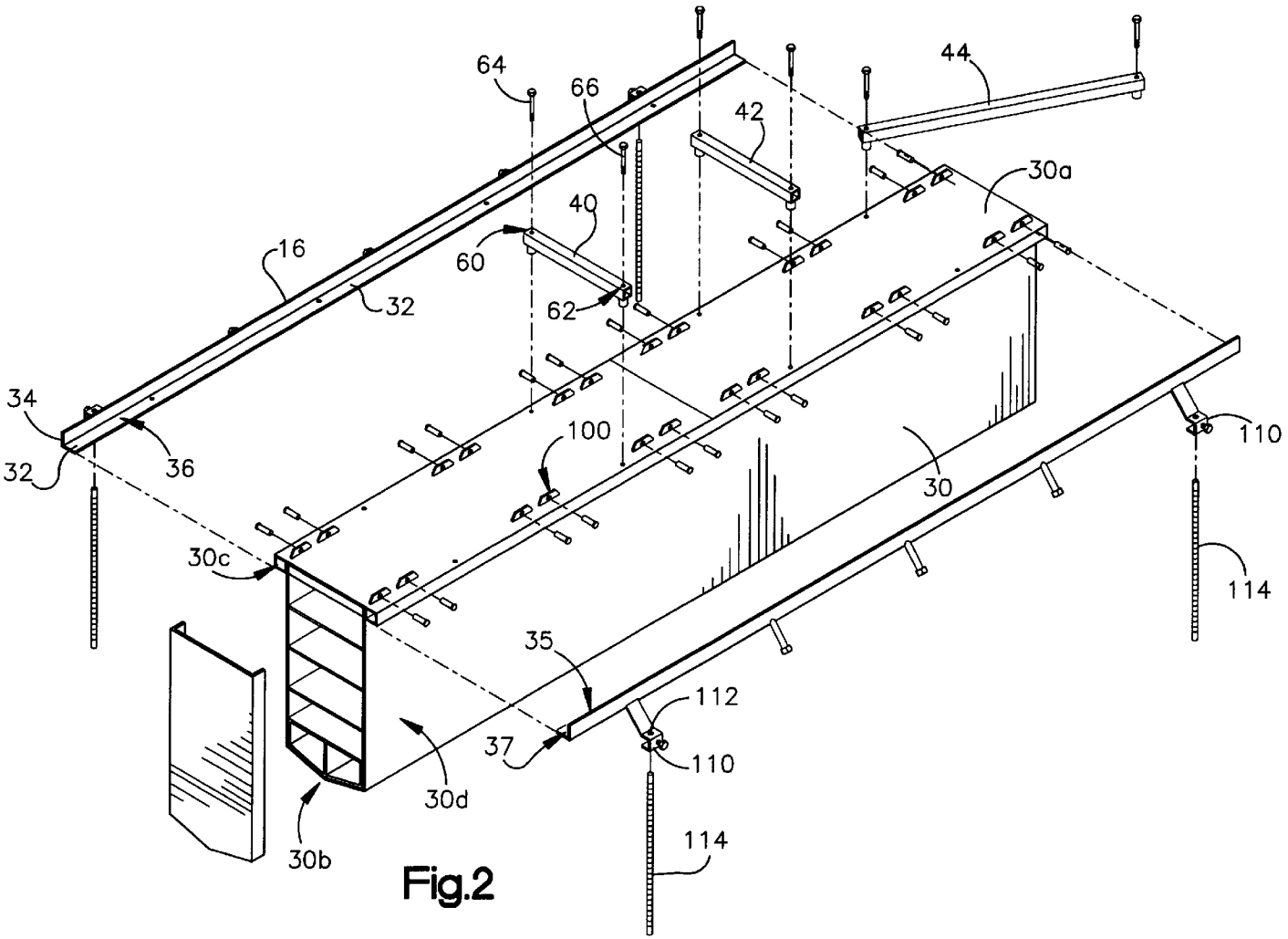
FIG. 2 is an exploded perspective of the trench drain forming apparatus illustrated in FIG. 1.
Figure 3A:
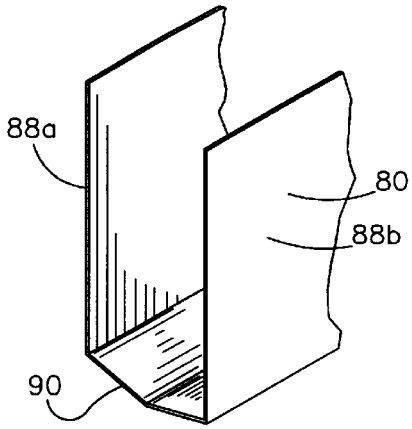
FIGS. 3A–3E are perspective views of a trench form of the apparatus illustrated in FIG. 1, showing progressive assembly steps.
Figure 3B:
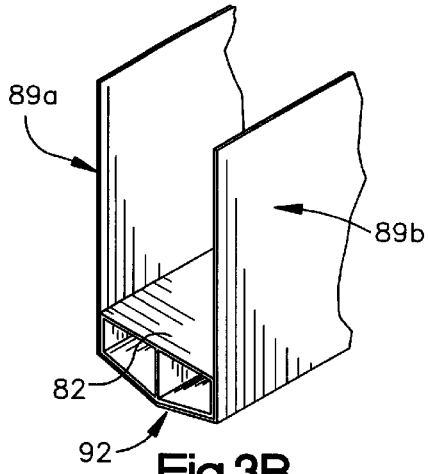
Figure 3C:
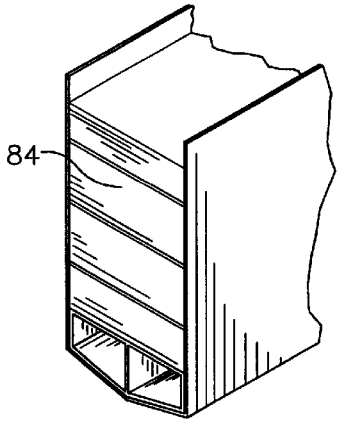
Figure 3D:
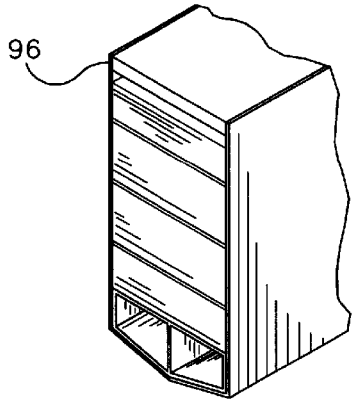
Figure 3E:
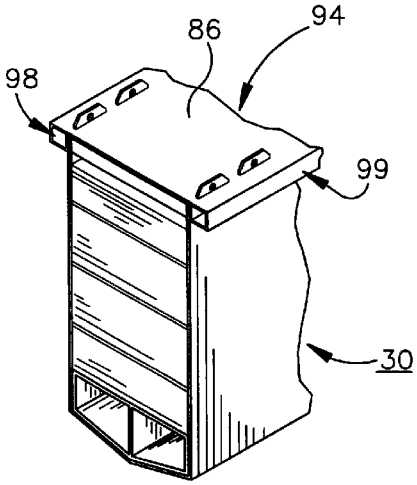
Figure 3F:
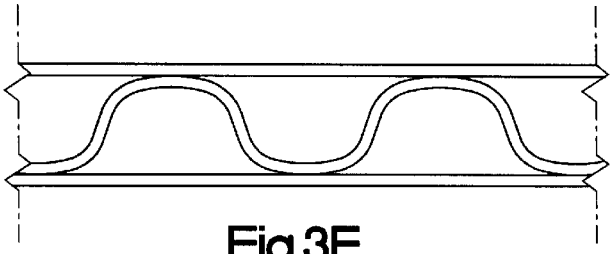
FIG. 3F is a cross-sectional view of a piece of corrugated cardboard that is used to construct members of the trench form in one embodiment of the present invention.

A first frame rail 16 and a second spaced apart frame rail 18 support the trench form 30. As best illustrated in FIG. 2, the first frame rail 16 includes a horizontal portion 32, a transverse portion 34 extending upwardly from the horizontal portion 32 and a trench form engaging surface 36. As illustrated, the trench form engaging surface 36 is defined by a surface of the horizontal portion 32 and a surface of the transverse portion 34. It will be apparent to others with ordinary skill in the art that the trench form engaging surface 36 may be defined by other combinations of frame rails surfaces, or a single frame rail surface. The surface 36 engages a portion of the trench form 30.

Figure 5:
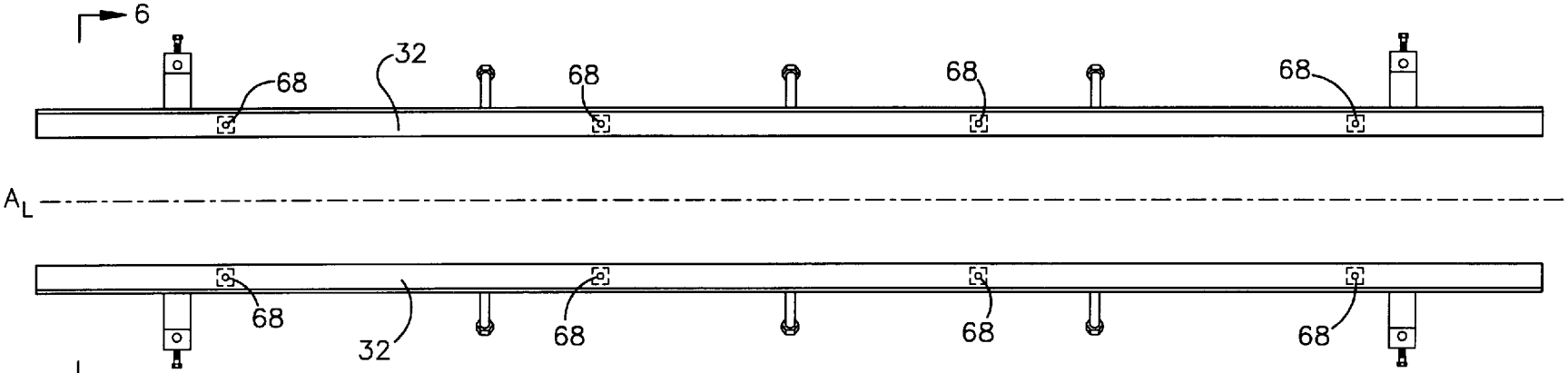
FIG. 5 is a top view of a set of frame rails of the apparatus illustrated in FIG. 1; showing a first and second frame rail aligned about a longitudinal axis.

The first 16 and second 18 frame rails include a plurality of mounting holes 68, as illustrated in FIG. 5. The holes 68 may be threaded. In one embodiment, mounting hardware for the metal grate is threaded into the holes 68.

Figure 6:
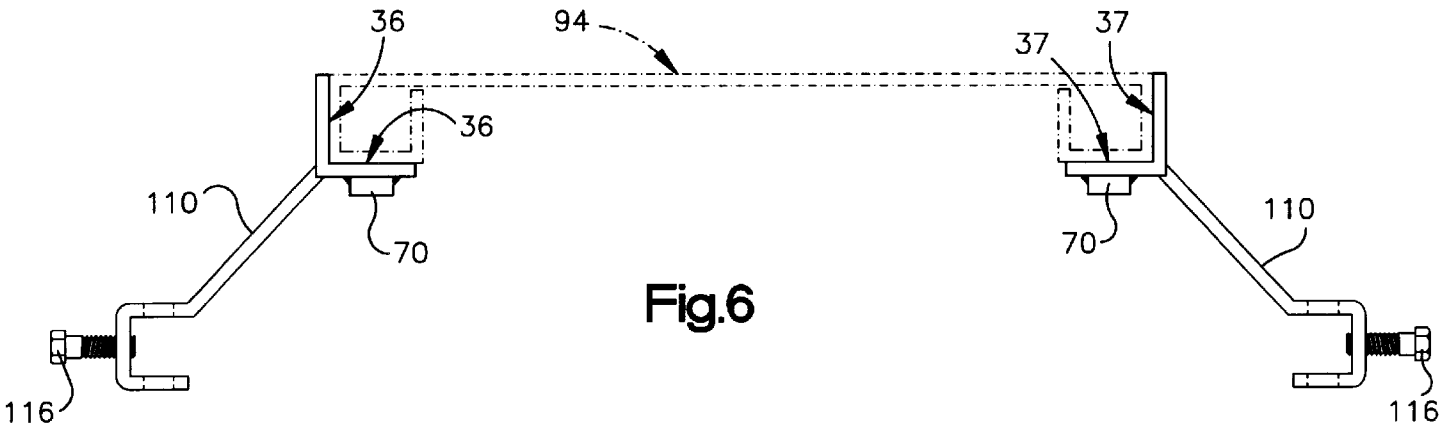
FIG. 6 is sectional view along the line 6—6 in FIG. 5, showing a first and second frame rail engaging the top form of the trench form.

The first 16 and second 18 frame rails may include at least one extending leg 110. The extending leg may include means for receiving an anchoring rod capable of being secured to ground defining the trench. As illustrated in FIG. 2, the means 112 for receiving an anchoring rod is a hole. As illustrated in FIG. 1, an anchoring rod 114 may extend through the hole 112, and further extend into the ground. The rod 114 may be forcibly inserted into the ground by hammering or other known method. A fastener 116 may be used to secure the anchoring rod 114 to the extending leg. 110. As illustrated in FIG. 6, a conventional threaded hex bolt 116 may be used to secure the anchoring rod 114.

Referring now to FIG. 2, an exploded perspective of the trench drain forming apparatus 10 is illustrated. The apparatus includes a trench form 30, a first frame rail 16, and second frame rail 18 and three supports members 40, 42, 44.

As discussed, the trench form 30 includes a plurality of folding members. As illustrated in FIG. 2, the members are folded along predetermined lines to define a top surface 30*a*, a bottom surface 30*b*, and first and second spaced apart side surfaces 30*c*, 30*d*. The form 30 is supported by the first and second frame rails 16, 18. The first frame rail 16 abuts against the first side surface 30*c* of the form 30. The second frame rail 18 abuts against the second side surface 30*d* of the form 30. FIG. 6 shows one portion of the trench form engaging the first 16 and second 18 frame rail.

Referring again to FIG. 1, the trench forming assembly 10 further includes at least one support member 40. The support member 40 is removably affixed to the first 16 and second frame rails 18. The support member 40 maintains the first 16 and second rails 18 in a fixed position relative to each other. The frame rails 16, 18 are fixed parallel to each other and to a longitudinal axis $A_L$, best shown in FIG. 5. The support member 40 advantageously does not permit any twisting or rotational movement of the rails. Once engaged by the support member, the rails are substantially at a fixed distance from each other at any point along the longitudinal axis $A_L$.

Figure 7A:
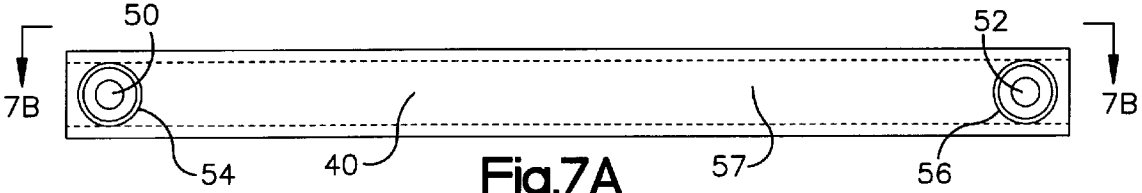
FIG. 7A is a top view of a support member of the apparatus illustrated in FIG. 1.
Figure 7B:
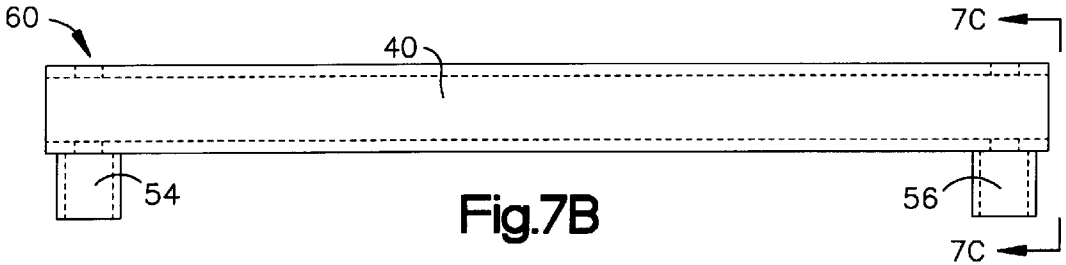
FIG. 7B is a side view of the support member illustrated in FIG. 7A.
Figure 7C:
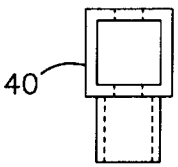
FIG. 7C is an end view of a support member illustrated in FIG. 7A.

Referring now to FIG. 7A, a top view of a support member 40 of the apparatus 10 shown in FIG. 1 is illustrated. FIG. 7B is a side elevation view of the support member 40 and FIG. 7C is an end view. The support member 40 includes a first opening 50 and a second opening 52 extending through the support member adjacent one end 54, 56 of the support member 40.

In one embodiment, the support member 40 further includes first 54 and second 56 vertically oriented cylindrical extensions. The extensions 54, 56 are sized to fit into corresponding first and second openings (not shown) in the form 30. The first and second openings in the form 30 are cooperatively aligned to the first 50 and second openings 52 and may be disposed in the top form 86. The openings may be manufactured by a die cut operation, or other known method. As illustrated, the first and second openings 50, 52 of the support member 40 extend through the cylindrical extensions 54, 56.

As illustrated, the support member includes a center portion 57 and two end portions 54, 56. The ends are composed of cylindrical steel conduit and may be fastened to the center portion by welding or other known method. It will be apparent to others skilled in the art that other construction methods for a support members may be used in practicing the present invention.

As illustrated in FIG. 1, the support member 40 is secured to the assembly 10 by the use of fasteners bearing against the support member 40. Referring again to FIG. 7B, a first fastener bearing surface 60 surrounds the first opening 50 and a second fastener bearing surface 62 surrounds the second opening 52. Any fastener used preferably is easily removed after application of the hardening material around the assembly 10. The first and second fastener bearing surfaces 60, 62 of the support member 40 are spaced above respective uppermost surfaces of the transverse portions 34, 35 of the first and second frame rails 16, 18. As illustrated in FIG. 1, the each fastener includes a threaded stud and a wing nut. The pair of wing nuts 63*a*, 63*b* bear against the top surface of the support member 40. The wing nuts are upwardly disposed above the transverse portions 34, 35 of the first and second frame rails 16, 18, as well as upwardly disposed from a top surface of the cured hardening material 22. This allows for ease of disassembly after the trench has been formed.

Figure 4:
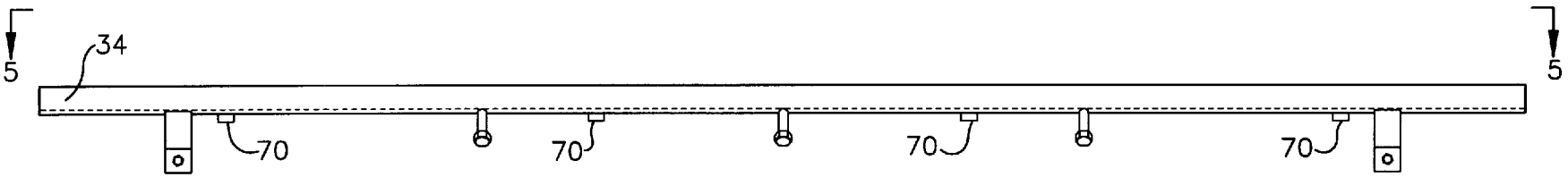
FIG. 4 is a side elevation view of a single frame rail of the apparatus illustrated in FIG. 1.

As illustrated in FIG. 2, the support member 40 is secured to the assembly 10 by the use of fasteners bearing against the support member 40. A first fastener 64 bears against the first fastener bearing surface 60 of the support member 40. The fastener 64 extends through the first opening 50 of the support member 40 and releasably engages the first frame rail 16. The frame rail 16 includes a plurality of holes 68 disposed in the horizontal portion 32. FIG. 4 is a side elevation view of a single frame rail. As illustrated in FIGS. 4 and 5, a threaded hole cap 70 may be disposed on a bottom surface of the rail 16 adjacent the bottom of the a hole 68. FIG. 5 is a top view of a set of frame rails of the apparatus illustrated in FIG. 1, showing a first and second frame rail aligned about a longitudinal axis. FIG. 6 is sectional view along the line 6—6 in FIG. 5, showing a first and second frame rail engaging a trench form.

In the embodiment illustrated in FIG. 2, the fasteners 64, 66 are bolts with a head having a tool-engaging surface. In FIG. 1, the first and second fasteners include threaded studs which are threaded into respective openings in the first 16 and second 18 frame rails and wing nuts 64, 66 which thread onto respective threaded studs and bear against respective first 60 and second 62 fastener bearing surfaces of the support member 40.

Referring now to FIGS. 3A–3E, a series of perspective views of a trench form of the apparatus illustrated in FIG. 1 are shown in progressive assembly steps. As illustrated, the trench form includes a plurality of pieces. The pieces may have scoring and perforation. The scoring or perforation facilitates folding and assembly. The scoring and perforation may be accomplished by conventional die-cut techniques. The pieces may be constructed of corrugated cardboard. The pieces may be hand formed and assembled into a finished unit. It will be apparent to others with ordinary skill in the art many different form designs may be employed in light of this disclosure. For example, a form including a single piece of corrugate may be utilized. Further, it should be understood other types of materials may be utilized in constructing the form other than corrugated cardboard.

As illustrated, the form 30 includes a outer form 80, a base form 82, a box form 84, and a top form 86. The outer form 80 has parallel first 88*a* and second 88*b* side walls. The side walls define first 89*a* and second side 89*b* surfaces of the form 30. The first 89*a* and second side 89*b* surfaces contact the hardening material and defines vertical walls of the trench. The outer form 80 further includes a bottom wall 90. The wall 90 defines a bottom surface 92 of the form 30. The bottom surface 92 also contacts the hardening material and defines a bottom surface of the trench.

As illustrated in FIGS. 3A–3E, in one embodiment the bottom wall 90 of the outer form 80 is V-shaped. A bottom wall 90 of this shape results in a V-shaped bottom for the trench drain after the hardening material has been poured in the trench and the trench form has been removed. A V-shaped trench is illustrated in FIG. 1. It is suggested a V-shaped bottom is advantageous for fluid flow dynamics.

The base form 82 is disposed in an interior region defined by the outer form 80. The base form 82 may be one piece. The base form as illustrated has a V-shaped bottom surface after assembly and is sized and configured to be downwardly disposed within the outer form 80.

The box form 84 is disposed in an interior region defined by the outer form 80. The box form 84 includes a plurality of cross members (not shown) extending between the first 88*a* and second side walls 88*b*. The cross members add rigidity and strength to the form 30. As previously discussed, buoyancy forces are imposed by the hardening material as it hardens. The form 30 must be designed to adequately absorb these forces without materially deforming. It will be apparent to others with ordinary skill in the art that a variety of cross member designs are possible in view of this disclosure.

The top form 86 has a top wall defining the top surface 94 of the form 30. During proper installation, the top surface 94 does not engage a material amount of hardening material. As discussed, the top form 86 includes a plurality of openings sized to accept cylindrical extensions 54, 56 of the support member 40.

The trench form 30 may further include an insert 96 disposed between an upper surface of the box form 84 and a lower surface of the top form 86. The insert 96 may be comprised of wood. The insert 96 may be added to increase the strength and rigidity to the form 30.

The form 30 may be configured such that opposing edges 98, 99 of the top form 86 are folded in the shape of a square. The edges 98, 99 may be disposed on respective trench form engaging surfaces 36, 37 of the first 16 and second 18 frame rails. The trench form engaging surfaces 36, 37 are best shown in FIG. 6.

Additional strength and rigidity may be added to the form 30. The top form 86 may include slots (not shown) through which upwardly extending tab portions 100 of the first 88*a* and second 88*b* side walls protrude. The tab portions 100 releasably secure the top form 86 to the outer form 80. The top form 86 may further include tabs which upwardly extend through the same or different slots. It will be apparent to others with ordinary skill in the art that a variety of tabs designs are possible in view of this disclosure.

In the embodiment illustrated in FIG. 2, three supports members 40, 42, 44 are included. In this illustrated embodiment of the present invention, two types of support members are included. As illustrated, two cross support members 40, 42 and one joint support member 44 are included. A cross support member is used to maintain proper alignment between two opposing frame rails. A joint support member is used to maintain proper alignment between a frame rail of one trench forming assembly and a frame rail of an adjacent trench forming assembly. As illustrated, the design of a cross support and a joint support may be similar. The joint support 44 is illustrated having a greater length than the cross support members 40, 42.

It will be apparent to others skilled in the art that any combination of cross support members and joint support members may be used in practicing the present invention. One combination will now be discussed.

Figure 8:
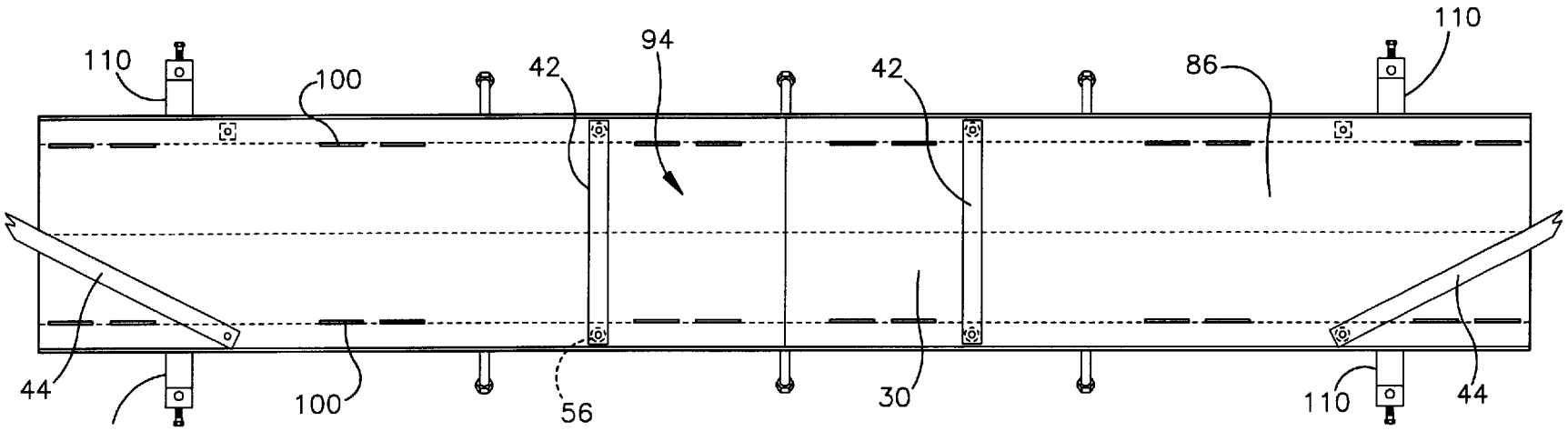
FIG. 8 is a top view of the apparatus illustrated in FIG. 1, showing a partial view of joint support members engaging adjacent trench forming apparatus.

FIG. 8 is a top view of one embodiment of the present invention. A partial view of two joint support members 44 are shown in a position engaging adjacent trench forming apparatus (not shown).

In the embodiment illustrated, a first form 30 and second elongated trench form (not shown) are inserted into a trench. A first and second spaced apart frame rail support the first trench form 30. A third and fourth spaced apart frame rail support the second trench form. The first and third frame rails are in longitudinal alignment, and the second and fourth frame rails are in longitudinal alignment. A joint support member 44 removably affixed to the first and fourth frame rails maintain the first and fourth frame rails in a fixed position relative to each other.

A method of forming a trench drain will now be briefly discussed. It will be apparent to others with ordinary skill in the art that this method may be varied dependent on the type and number of support members used, in view of this disclosure.

The method begins with the first step of forming a trench in the ground extending along a longitudinal axis. The trench may be formed by known excavation methods. Alternatively, the trench may be pre-existing.

A first trench form is assembled of a plurality of folding members folded along predetermined lines. The assembly of the trench form is typically done outside the trench in an adjacent or near by area. A first frame rail is positioned on one longitudinal side of the trench form. The frame rail may be held in place so that the trench form engaging surface abuts the trench form. In parallel, a second frame rail may be positioned on an opposing longitudinal side of the trench form. The second frame rail may be held in place so that the trench form engaging surface abuts the trench form.

A support member is now provided. In one embodiment, extensions disposed on opposing ends of the support member are inserted into holes provided in the top form. The next step is securing the support member to the first and second frame rails by fastening a first fastener between the support member and the first frame rail and a second fastener between the support member and the second frame rail.

The first fastener bears against the first fastener bearing surface of the support member, extends through the first opening of the support member, and releasably engages the first frame rail. The second fastener bears against the second fastener bearing surface of the support member, extends through the second opening of the support member, and releasably engages the second frame rail. In one embodiment, a threaded stud is dropped through the cylindrical extension, engages a threaded hole cap beneath the frame rail, and is secured by a wing nut.

The trench forming apparatus is now secured and may be manually moved into the trench. Anchoring rods may be driven into the ground and secured to extending legs.

A second trench forming apparatus may now be formed by similar method steps. The second trench forming apparatus may be placed in the trench adjacent the first apparatus. A joint support member may be used to maintain alignment between the first and second apparatus.

Subsequent trench forming apparatus are assembled and installed within the trench until the desired trench length is satisfied. A hardening compound is applied into the trench in areas adjacent the trench forms. All fasteners, support members and trench forms are removed after the material has hardened. The frame rails are not removed. Any extending leg or anchoring rod utilized are would now be encased in hardening material.

Next, a series of grates is installed. The grate may be mounted utilizing the threaded holes provided in the frame rails.

While the present invention has been described with a degree of particularity, it is the intent that the invention include all modifications and alterations from the disclosed embodiment falling within the spirit or scope of the appended claims.

What is claimed is:

1. An apparatus for forming a trench drain comprising:

a) an elongated trench form for insertion into a trench along a longitudinal axis of the trench, wherein the form is comprised of at least one folding member folded along predetermined lines to define a top surface, a bottom surface, and first and second spaced apart side surfaces;

b) first and second spaced apart frame rails supporting the trench form, each of the first and second frame rails comprising a horizontal portion, a transverse portion extending upwardly from the horizontal portion and a trench form engaging surface, the first frame rail abutting the first side surface of the form and the second frame rail abutting the second side surface of the form;

c) a support member removably affixed to the first and second frame rails to maintain the first and second rails in a fixed position relative to each other, the support member including a first opening extending through the support member adjacent one end of the support member and a first fastener bearing surface surrounding the first opening and a second opening extending through the support member adjacent an opposite end of the support member and a second fastener bearing surface surrounding the second opening, the first and second fastener bearing surfaces of the support member being spaced above respective uppermost surfaces of the transverse portions of the first and second frame rails; and d) a first fastener bearing against the first fastener bearing surface of the support member, extending through the first opening of the support member, and releasably engaging the first frame rail and a second fastener bearing against the second fastener bearing surface of the support member, extending through the second opening of the support member, and releasably engaging the second frame rail;

e) wherein said trench form is comprised of an outer form having parallel first and second side walls defining the first and second side surfaces and a bottom wall defining the bottom surface, a base form disposed in an interior region defined by the outer form, a box form disposed in the interior region defined by the outer form, the box form including a plurality of cross members extending between the first and second side walls, and a top form having a top wall defining the top surface.

2. The apparatus according to claim 1 wherein the trench form is comprised of corrugated cardboard.

3. The apparatus according to claim 1 wherein opposing edges of the top form are folded in the shape of a square and are disposed on the respective trench form engaging surfaces of the first and second frame rails.

4. The apparatus according to claim 1 wherein the top form includes slots through which upwardly extending tab portions of the first and second side walls protrude to releasably secure the top form to the outer form.

5. The apparatus according to claim 1 wherein the support member further includes first and second vertically oriented cylindrical extensions sized to fit into corresponding first and second openings in the top form wherein the first and second openings of the support member extend through the cylindrical extensions.

6. The apparatus according to claim 1 wherein bottom wall of the outer form is V-shaped resulting in a V-shaped bottom for the trench drain after hardening material has been poured in the trench and the trench form has been removed.

7. The apparatus according to claim 1 wherein the trench form further includes an insert disposed between an upper surface of the box form and a lower surface of the top form.

8. The apparatus according to claim 7 wherein the insert is comprised of wood.

9. The apparatus according to claim 1 wherein the predetermined lines are weakened by scoring or perforation to facilitate folding.

10. The apparatus according to claim 1 wherein the first and second fasteners include threaded studs which are threaded into respective threaded openings in the first and second frame rails and further include wing nuts which thread onto the respective threaded studs and bear against the respective first and second fastener bearing surfaces of the support member.

11. The apparatus according to claim 1 wherein each of the first and second frame rails comprises at least one extending leg, said at least one extending leg comprising means for receiving an anchoring rod capable of being secured to ground defining the trench.

12. An assembly for forming a trench drain comprising:

a) first and second elongated trench forms for insertion into a trench, wherein each of the first and second forms are comprised of at least one folding member folded along predetermined lines to define a top surface, a bottom surface, and first and second spaced apart side surfaces, the first and second forms being positioned in longitudinal alignment to extend along a longitudinal axis of the trench;

b) a first set of frame rails comprising first and second spaced apart frame rails to support the first trench form, each of the first and second frame rails comprising a horizontal portion, a transverse portion extending upwardly from the horizontal portion and a trench form engaging surface, the first frame rail abutting the first side surface of the form and the second frame rail abutting the second side surface of the form;

c) a second set of frame rails comprising third and fourth spaced apart frame rails to support the second trench form, each of the first and second frame rails comprising a horizontal portion, a transverse portion extending upwardly from the horizontal portion and a trench form engaging surface, the third frame rail abutting the first side surface of the form and the fourth frame rail abutting the second side surface of the form, the first and third frame rails being in alignment and the second and fourth frame rails being in alignment;

d) a first cross support member removably affixed to the first and second frame rails of the first set of frame rails to maintain the first and second rails in a fixed position relative to each other;

e) a second cross support member removably affixed to the third and fourth frame rails of the second set of frame rails to maintain the third and fourth rails in a fixed position relative to each other;

f) a joint support member removably affixed to the first and fourth frame rails to maintain the first and fourth frame rails in a fixed position relative to each other, the support member including a first opening extending through the support member adjacent one end of the support member and a first fastener bearing surface surrounding the first opening and a second opening extending through the support member adjacent an opposite end of the joint member and a second fastener bearing surface surrounding the second opening, the first and second fastener bearing surfaces of the joint member being spaced above respective uppermost surfaces of the transverse portions of the first and fourth frame rails; and g) a first fastener bearing against the first fastener bearing surface of the joint support member, extending through the first opening of the joint support member, and releasably engaging the first frame rail and a second fastener bearing against the second fastener bearing surface of the joint support member, extending through the second opening of the joint support member, and releasably engaging the fourth frame rail;

h) wherein the first and second trench form are each comprised of an outer form having parallel first and second side walls defining the first and second side surfaces and a bottom wall defining the bottom surface, a base form disposed in an interior region defined by the outer form, a box form disposed in an interior region defined by the outer form, the box form including a plurality of cross members extending between the first and second side walls, and a top form having a top wall defining the top surface.

13. The assembly according to claim 12 wherein the first and second trench forms are comprised of corrugated cardboard.

14. The assembly according to claim 12 wherein for each of the first and second trench forms opposing edges of the top form are folded in the shape of a square and are disposed on the respective trench forms engaging surfaces of the first and second frame rails and third and fourth frame rails.

15. The assembly according to claim 12 wherein for each of the first and second trench forms the top form includes slots through which upwardly extending tab portions for the first and second side walls protrude to releasably secure the top form to the outer form.

16. The assembly according to claim 12 wherein the joint support member further includes first and second vertically oriented cylindrical extensions sized to fit into corresponding first and second openings in the top forms of the respective first and second trench forms wherein the first and second openings of the joint support member extend through the cylindrical extensions.

17. The assembly according to claim 12 wherein for each of the first and second trench forms the bottom wall of the outer form is V-shaped resulting in a V-shaped bottom for the trench drain after hardening material has been poured in the trench and the first and second trench forms have been removed.

18. The assembly according to claim 12 wherein the first and second trench forms each further includes an insert disposed between an upper surface of the box form and a lower surface of the top form.

19. The assembly according to claim 18 wherein the insert is comprised of wood.

20. The assembly according to claim 12 wherein the predetermined lines of each of the first and second trench forms are weakened by scoring or perforation to facilitate folding.

21. The assembly according to claim 12 wherein the first and second fasteners include threaded studs which are threaded into respective threaded openings in the first and fourth frame rails and further include wing nuts which thread onto the respective threaded studs and bear against the respective first and second fastener bearing surfaces of the joint support member.

22. The assembly according to claim 12 wherein each of the first, second, third and fourth frame rails comprise at least one extending leg, said at least one extending leg comprising means for receiving an anchoring rod capable of being secured to ground defining the trench.

23. An assembly for forming a trench drain comprising:

a) first and second elongated trench forms for insertion into a trench, wherein each of the first and second forms are comprised of at least one folding member folded along predetermined lines to define a top surface, a bottom surface, and first and second spaced apart side surfaces, the first and second forms being positioned in longitudinal alignment to extend along a longitudinal axis of the trench, wherein each of the first and second forms are further comprised of an outer form having parallel first and second side walls defining the first and second side surface and a bottom wall defining the bottom surface, a base form disposed in an interior region defined by the outer form, a box form disposed in the interior region defined by the outer form, the box form including a plurality of cross members extending between the first and second side walls, and a top form having a top wall defining the top surface;

b) a first set of frame rails comprising first and second spaced apart frame rails to support the first trench form, each of the first and second rails comprising a horizontal portion, a transverse portion extending upwardly from the horizontal portion and a trench form engaging surface, the first frame rail abutting the first side surface of the form and the second frame rail abutting the second side surface of the form;

c) a second set of frame rails comprising third and fourth spaced apart frame rails to support the second trench form, each of the third and fourth rails comprising a horizontal portion, a transverse portion extending upwardly from the horizontal portion and a trench form engaging surface, the third frame rail abutting the first side surface of the form and the fourth frame rail abutting the second side surface of the form, the first and third frame rails being in longitudinal alignment and the second and fourth frame rails being in longitudinal alignment;

d) a first cross support member removably affixed to the first and second frame rails of the first set of frame rails to maintain the first and second rails in a fixed position relative to each other, the first cross support member including a first opening extending through the first cross support member adjacent one end of the first cross support member and a first fastener bearing surface surrounding the first opening and a second opening extending through the first cross support member adjacent an opposite end of the first cross support member and a second fastener bearing surface surrounding the second opening, the first and second fastener bearing surfaces of the first cross support member being spaced above respective uppermost surfaces of the transverse portions of the first and second frame rails;

e) a first fastener bearing against the first fastener bearing surface of the first cross support member, extending through the first opening of the first cross support member, and releasably engaging the first frame rail and a second fastener bearing against the second fastener bearing surface of the first cross support member, extending through the second opening of the first cross support member, and releasably engaging the second frame rail;

f) a second cross support member removably affixed to the third and fourth frame rails of the second set of frame rails to maintain the third and fourth rails in a fixed position relative to each other, the second cross support member including a first opening extending through the second cross support member adjacent one end of the second cross support member and a first fastener bearing surface surrounding the first opening and a second opening extending through the second cross support member adjacent an opposite end of the second cross support member and a second fastener bearing surface surrounding the second opening, the first and second fastener bearing surfaces of the second cross support member being spaced above respective uppermost surfaces of the transverse portions of the third and fourth frame rails;

g) a third fastener bearing against the first fastener bearing surface of the second cross support member, extending through the first opening of the second cross support member, and releasably engaging the third frame rail and a fourth fastener bearing against the second fastener bearing surface of the second cross support member, extending through the second opening of the second cross support member, and releasably engaging the fourth frame rail;

h) a joint support member removably affixed to the first and fourth frame rails to maintain the first and fourth frame rails in a fixed position relative to each other, the joint support member including a first opening extending through the joint support member adjacent one end of the joint support member and a first fastener bearing surface surrounding the first opening and a second opening extending through the joint support member adjacent an opposite end of the joint support member and a second fastener bearing surface surrounding the second opening, the first and second fastener bearing surfaces of the joint support member being spaced above respective uppermost surfaces of the transverse portions of the first and fourth frame rails; and i) a fifth fastener bearing against the first fastener bearing surface of the joint support member, extending through the first opening of the joint support member, and releasably engaging the first frame rail and a sixth fastener bearing against the second fastener bearing surface of the joint support member, extending through the second opening of the joint support member, and releasably engaging the fourth frame rail.

24. A method of forming a trench drain comprising:

a) forming a trench in the ground, the trench extending along a longitudinal axis;

b) assembling a trench form comprised of an outer form having parallel first and second side walls defining a first and second side surface and a bottom wall defining a bottom surface, a base form disposed in an interior region defined by the outer form, a box form disposed in the interior region defined by the outer form, the box form including a plurality of cross members extending between the first and second side walls, and a top form having a top wall defining a top surface;

c) positioning a first set of frame rails comprising first and second frame rails in spaced apart relationship so as to extend along the longitudinal axis of the trench and to engage and support the trench form, each of the first and second frame rails having a horizontal portion and a trench form engaging surface;

d) positioning the trench form so as to engage and be supported by the first and second frame rails;

e) providing a support member to releasably secure the first frame rail to the second frame rail to maintain said first and second rails in a fixed position relative to each other, the support member including a first opening extending through the support member adjacent one end of the support member and a first fastener bearing surface surrounding the first opening and a second opening extending through the support member adjacent an opposite end of the support member and a second fastener bearing surface surrounding the second opening, the first and second fastener bearing surfaces of the support member being spaced above respective uppermost surfaces of the first and second frame rails;

f) securing the support member to the first and second frame rails by:

1) fastening a first fastener between the support member and the first frame rail, the first fastener bearing against the first fastener bearing surface of the support member, extending through the first opening of the support member, and releasably engaging the first frame rail; and 2) fastening a second fastener between the support member and the second frame rail, the second fastener bearing against the second fastener bearing surface of the support member, extending through the second opening of the support member, and releasably engaging the second frame rail;

g) applying hardening compound into the trench in areas adjacent the trench form; and h) removing the first and second fasteners, the support member and the trench form.

25. A method of forming a trench drain comprising:

a) forming a trench in the ground, the trench extending along a longitudinal axis;

b) assembling first and second trench forms, each of said trench forms comprised of an outer form having parallel first and second side walls defining a first and second side surface and a bottom wall defining a bottom surface, a base form disposed in an interior region defined by the outer form, a box form disposed in the interior region defined by the outer form, the box form including a plurality of cross members extending between the first and second side walls, and a top form having a top wall defining a top surface;

c) positioning a first set of frame rails comprising first and second frame rails in spaced apart relationship so as to extend along the longitudinal axis of the trench and to engage and support the first trench form, each of the first and second frame rails having a horizontal portion and a trench form engaging portion;

d) positioning the first trench form so as to engage and be supported by the first and second frame rails;

e) positioning a second set of frame rails comprising third and fourth frame rails in spaced apart relationship so as to extend along the longitudinal axis of the trench and to engage and support the second trench form, each of the third and fourth frame rails having a horizontal portion and a trench former engaging surface, the first and third frame rails being in longitudinal alignment and the second and fourth frame rails being in longitudinal alignment;

f) positioning the second trench form so as to engage and be supported by the third and fourth frame rails;

g) providing a joint support member to releasably secure the first frame rail to the fourth frame rail, the joint support member adapted to removably engage said first and fourth frame rails to maintain said first and fourth rails in a fixed position relative to each other, the joint support member including a first opening extending through the joint support member adjacent one end of the support member and a first fastener bearing surface surrounding the first opening and a second opening extending through the joint support member adjacent an opposite end of the support member and a second fastener bearing surface surrounding the second opening, the first and second fastener bearing surfaces of the joint support member being spaced above respective uppermost surfaces of the trench form engaging portion of the first and fourth frame rails;

h) securing the joint support member to the first and fourth frame rails by:

1) fastening a first fastener between the joint support member and the first frame rail, the first fastener bearing against the first fastener bearing surface of the joint support member, extending through the first opening of the joint support member, and releasably engaging the first frame rail; and 2) fastening a second fastener between the joint support member and the fourth frame rail, the second fastener bearing against the second fastener bearing surface of the cross support member, extending through the second opening of the cross support member, and releasably engaging the fourth frame rail;

i) applying hardening compound into the trench in areas adjacent the first and second trench forms; and j) removing the first and second fasteners, the joint support member and the first and second trench forms.

* * * * *